US010738663B2

(12) United States Patent
Jang et al.

(10) Patent No.: US 10,738,663 B2
(45) Date of Patent: Aug. 11, 2020

(54) LOCKING STRUCTURE OF VALVE TIMING ADJUSTMENT APPARATUS FOR INTERNAL COMBUSTION ENGINE

(71) Applicants: Hyundai Motor Company, Seoul (KR); KIA Motors Corporation, Seoul (KR); Delphi Powertrain Systems Korea Ltd., Changwon-si, Gyeongsangnam-do (KR); Pine Engineering Ltd., Changwon-si, Gyeongsangnam-do (KR)

(72) Inventors: Koun Young Jang, Changwon-si (KR); Sung Dae Kim, Changwon-si (KR); Sang Ho Lee, Changwon-si (KR); Jae Young Kang, Changwon-si (KR); Sung Hoon Baek, Gimhae-si (KR); Soo Deok Ahn, Changwon-si (KR)

(73) Assignees: HYUNDAI MOTOR COMPANY, Seoul (KR); KIA MOTORS CORPORATION, Seoul (KR); DELPHI POWERTRAIN SYSTEMS KOREA LTD., Changwon-si, Gyeongsangnam-Do (KR); PINE ENGINEERING LTD., Changwon-si, Gyeongsangnam-Do (KR)

( * ) Notice: Subject to any disclaimer, the term of this patent is extended or adjusted under 35 U.S.C. 154(b) by 905 days.

(21) Appl. No.: 15/382,946

(22) Filed: Dec. 19, 2016

(65) Prior Publication Data

US 2017/0183986 A1 Jun. 29, 2017

(30) Foreign Application Priority Data

Dec. 23, 2015 (KR) ..... 10-2015-0185272

(51) Int. Cl.
*F01L 1/344* (2006.01)

(52) U.S. Cl.
CPC ... *F01L 1/3442* (2013.01); *F01L 2001/34433* (2013.01); *F01L 2001/34459* (2013.01);
(Continued)

(58) Field of Classification Search
CPC . F01L 1/34; F01L 1/344; F01L 1/3442; F01L 2001/3443; F01L 2001/34459;
(Continued)

(56) References Cited

U.S. PATENT DOCUMENTS 5,924,395 A 7/1999 Moriya et al.
6,276,322 B1 8/2001 Sekiya et al.
(Continued)

FOREIGN PATENT DOCUMENTS

JP H09-324613 A 12/1997
JP H11-062521 A 3/1999
(Continued)

OTHER PUBLICATIONS

Korean Office Action dated Jun. 20, 2017 form the corresponding Korean Application No. 10-2016-0001689, 6 pp.
(Continued)

*Primary Examiner* — Mark A Laurenzi
*Assistant Examiner* — Loren C Edwards
(74) *Attorney, Agent, or Firm* — Brinks Gilson & Lione

(57) ABSTRACT

The present disclosure provides a locking structure of a valve timing adjustment apparatus for an internal combustion engine, using torque from a camshaft and the pressure of working fluid. The locking structure includes an anti-rotation mechanism for inhibiting or preventing a position change between a rotor and a housing by preventing relative rotation of the rotor to the housing. The anti-rotation mechanism further includes: a plurality of locking grooves which are formed on the ratchet plate with different depths and connected to each other; and a locking pin member. In
(Continued)

particular, the locking pin member has: a hollow outer pin elastically disposed in a fitting hole formed in vanes, an inner pin elastically disposed inside the outer pin, and a lifter ring coupled to the upper portion of the outer pin to slide on the inner side of the fitting hole.

9 Claims, 5 Drawing Sheets

(52) U.S. Cl.
CPC ..... *F01L 2001/34463* (2013.01); *F01L 2001/34466* (2013.01); *F01L 2001/34469* (2013.01); *F01L 2001/34479* (2013.01); *F01L 2250/02* (2013.01); *F01L 2250/04* (2013.01)

(58) Field of Classification Search
CPC ... F01L 2001/34463; F01L 2001/34479; F01L 1/047; F01L 2250/02; F01L 2250/04; F01L 2820/02; F02D 13/0219; Y02T 10/18
USPC ..... 123/90.15, 90.16
See application file for complete search history.

(56) References Cited

U.S. PATENT DOCUMENTS

| | | | | |
|---|---|---|---|---|
| 2002/0152978 | A1 | 10/2002 | Todo | |
| 2012/0000437 | A1 | 1/2012 | Ozawa et al. | |
| 2012/0055429 | A1* | 3/2012 | Nakamura | F01L 1/3442 123/90.17 |
| 2013/0104820 | A1 | 5/2013 | Watanabe | |
| 2013/0180481 | A1 | 7/2013 | Kato et al. | |
| 2016/0024978 | A1 | 1/2016 | Lichti | |
| 2016/0230614 | A1 | 8/2016 | Scheidig et al. | |
| 2017/0022854 | A1 | 1/2017 | Takada | |
| 2017/0130617 | A1 | 5/2017 | Haltiner, Jr. et al. | |

FOREIGN PATENT DOCUMENTS

| | | | |
|---|---|---|---|
| JP | 2000-002104 | A | 1/2000 |
| JP | 2000-179310 | A | 6/2000 |
| JP | 2001-050016 | A | 2/2001 |
| JP | 2002-357105 | A | 12/2002 |
| JP | 2010-285986 | A | 12/2010 |
| JP | 2012-057487 | A | 3/2012 |
| JP | 2013-155612 | A | 8/2013 |
| KR | 10-2010-0132923 | A | 12/2010 |
| KR | 10-2012-0032510 | A | 4/2012 |

OTHER PUBLICATIONS

Notice of Allowance dated Sep. 17, 2018 from the corresponding U.S. Appl. No. 15/423,237, 19 pages.
Non-Final Office Action dated Jul. 12, 2018 from the corresponding U.S. Appl. No. 15/449,290, 9 pages.
Chinese Office Action dated Dec. 24, 2019 from the corresponding Chinese Application No. 201611194857.7, 7 pp.

* cited by examiner

LOCKING STRUCTURE OF VALVE TIMING ADJUSTMENT APPARATUS FOR INTERNAL COMBUSTION ENGINE

CROSS REFERENCE TO RELATED APPLICATION

The present application claims priority to and the benefit of Korean Patent Application No. 10-2015-0185272, filed Dec. 23, 2015, the entire contents of which is incorporated herein by reference in its entirety.

FIELD

The present disclosure relates to a valve timing adjustment apparatus for an internal combustion engine.

BACKGROUND

The statements in this section merely provide background information related to the present disclosure and may not constitute prior art.

In general, an internal combustion engine (hereafter, referred to as an "engine") is equipped with a valve timing adjustment apparatus that can change timing of intake valves and an exhaust valves, depending on the operation state of the engine. Such a valve timing adjustment apparatus adjusts the timing of intake valves or exhaust valves by changing a phase angle according to the displacement or rotation of a camshaft connected to a crankshaft usually through a timing belt or a chain, and various types of valve timing adjustment apparatus have been proposed.

In general, a vane type valve timing adjustment apparatus that includes a rotor having a plurality of vanes freely rotated by working fluid in a housing is generally used.

The vane type valve timing adjustment apparatus adjusts valve timing using a difference in rotational phase generated due to relative rotation in an advance direction or a retard direction of a rotor that is rotated through vanes operated by the pressure of working fluid to an advance chamber or a retard chamber between a full advance phase angle and a full retard phase angle.

We have discovered that a positive torque is generated by friction due to rotation of a cam in opposite direction to the rotational direction of the cam. Meanwhile, the negative torque is generated by restoring force of a valve spring in the same direction as the rotational direction of the cam when a valve starts closing and the negative torque is smaller than the positive torque.

SUMMARY

The present disclosure provides a locking structure of a valve timing adjustment apparatus for an internal combustion engine. The structure is able to reduce the manufacturing cost and improve productivity by reducing an accumulative tolerance of components.

In one form of the present disclosure, there is provided a locking structure of a valve timing adjustment apparatus for an internal combustion engine. The apparatus is coupled to a camshaft operating with a crankshaft to adjust valve timing of at least one of an intake valve and an exhaust valve using torque from the camshaft and pressure of working fluid. The structure includes: a housing defining a space with a latchet plate operatively associated with a crankshaft; a rotor having a plurality of vanes configured to rotate relative to the housing within a predetermined angle range by the pressure of the working fluid, the rotor disposed in the housing to operate with the camshaft; and an anti-rotation mechanism configured to inhibit or prevent a positional change between the rotor and the housing by inhibiting or preventing relative rotation of the rotor to the housing.

In particular, the anti-rotation mechanism includes: a plurality of locking grooves formed on the ratchet plate with different depths and connected to each other; and a locking pin member. The locking pin member includes: an outer pin elastically disposed in a fitting hole formed in at least one of the plurality of vanes; an inner pin elastically disposed inside the outer pin; and a lifter ring coupled to an upper portion of the outer pin and configured to slide on an inner side of the fitting hole. The lifter ring is configured to lock the rotor to the housing when the outer pin and the inner pin are sequentially fitted in the plurality of locking grooves.

The locking grooves may include a large groove and a small groove having a large diameter or a small diameter, respectively, so as to form a stepped portion having predetermined depths.

The locking pin member may further have an upper cap having a first recession therein and configured to close a first end of the fitting hole.

A second recession may be formed at a first end of the outer pin, and an outer spring applying elasticity to the locking grooves may be disposed between the second recession and a first end of the upper cap.

A first flange may protrude from the second recession of the outer pin, and a second flange coupled to the first flange of the outer pin may protrude from a lower end of the lifter ring.

A third recession may be formed at a first end of the inner pin, and an inner spring applying elasticity to the locking grooves may be disposed between the third recession and the first recession of the upper cap.

A first exhaust hole configured to discharg the working fluid when the locking pin member is locked may be additionally formed in the ratchet plate.

A second exhaust hole configured to communicate with the first exhaust hole may be additionally formed in the rotor to discharge the working fluid from the locking grooves when the locking pin member is locked.

The locking pin member may further have a lower cap configured to close a second end of the fitting hole and configured to support an outer side of the outer pin.

According to another form of the present disclosure, there is provided a valve timing adjustment apparatus for an internal combustion engine, the apparatus including: a body having a plurality of oil ports on an outer side thereof and operating with a camshaft; a solenoid valve including a spool, which has a plurality of oil grooves 6*a* around an outer side and is elastically supported by a spring, and disposed in the body to control flow of working fluid by selectively communicating with the oil ports of the body in response to a control signal; a controller transmitting the control signal to the solenoid valve, and the locking structure of a valve timing adjustment apparatus for an internal combustion engine, the structure being operated in response to the control signal from the controller.

According to the present disclosure, the lifter ring disposed between the fitting hole of the rotor and the outer pin slides up and down on the inner side of the fitting hole, so that the load for controlling a tolerance of the locking pin member including the outer pin, the inner pin, and other components can be reduced and thus the manufacturing cost is reduced and productivity is improved.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
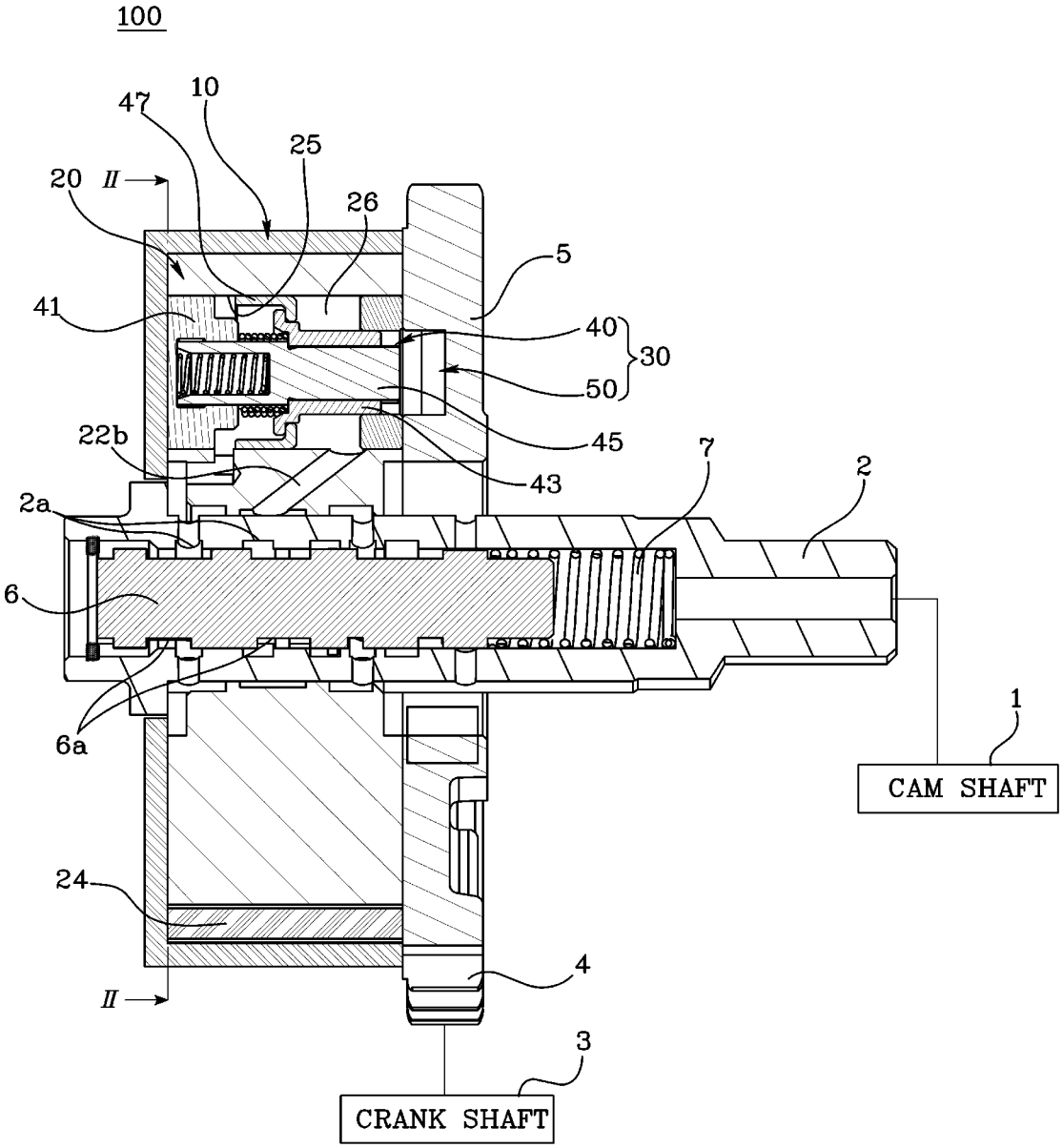
FIG. 1 is a cross-sectional view of a valve timing adjustment apparatus.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

A valve timing adjustment apparatus for an internal combustion engine according to one form of the present disclosure is described hereafter in detail with reference to the accompanying drawings.

FIG. 1 is a cross-sectional assembly view of a valve timing adjustment apparatus 100 in one exemplary form of the present disclosure.

Figure 2:
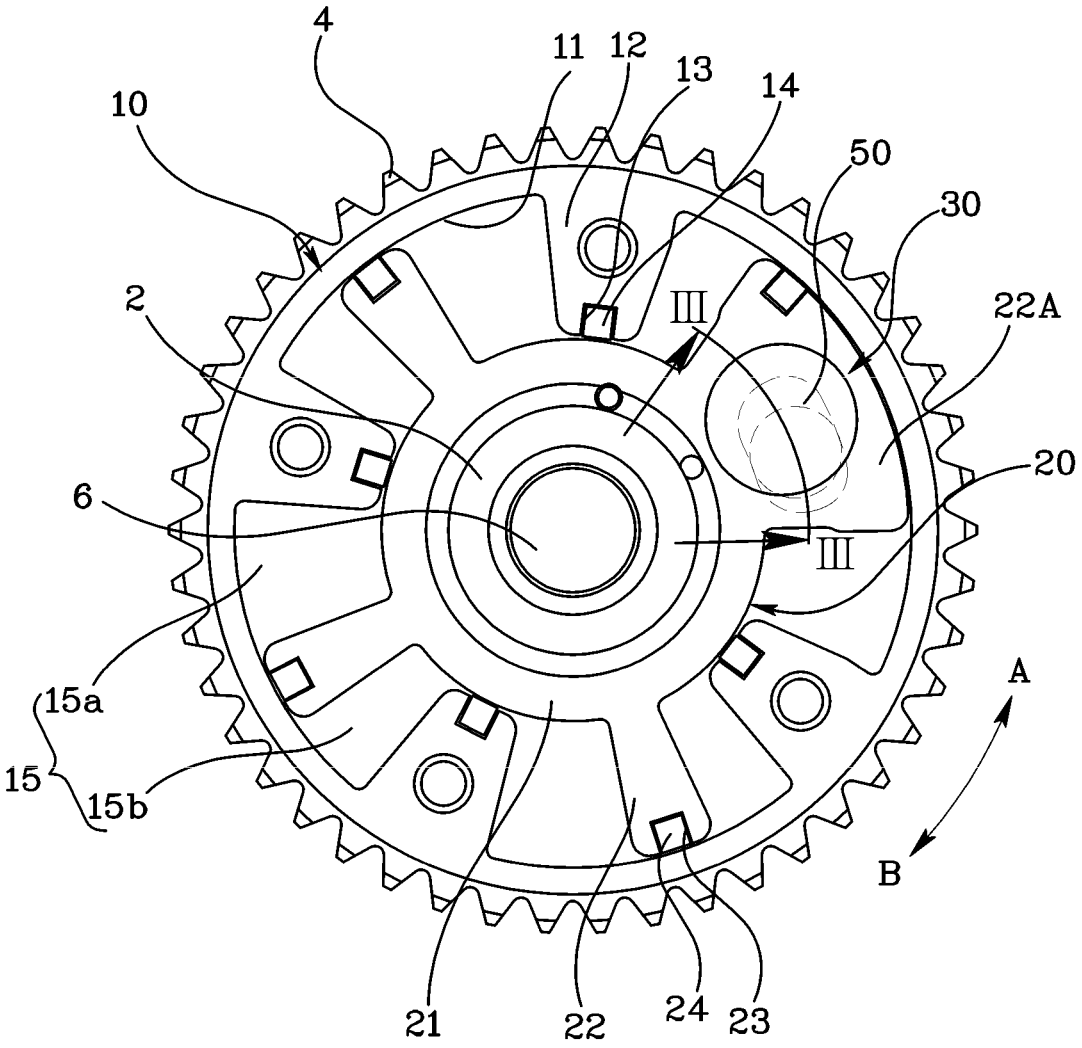
FIG. 2 is a front view taken along line II-II of FIG. 1.
Figure 3:
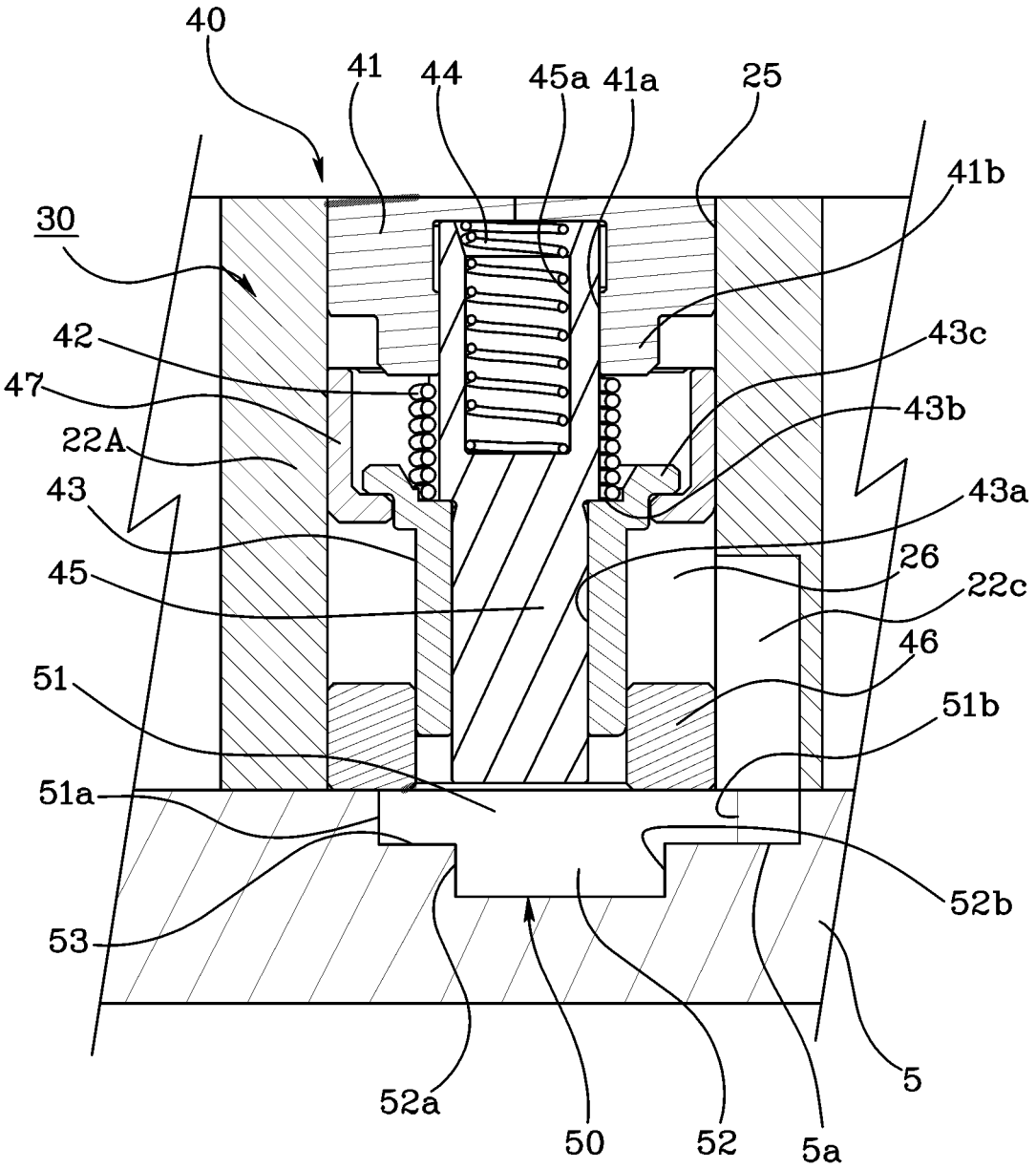
FIG. 3 is a sectional view taken along line III-III of FIG. 2.

Referring to FIGS. 1 to 3, the valve timing adjustment apparatus 100 has a body 2 that is coupled to a camshaft 1 in an internal combustion engine, in which a sprocket 4 that is coupled to a crankshaft 3 through a chain or a timing belt (not shown) is rotatably disposed on the body 2, and a disc-shaped ratchet plate 5 is integrally formed inside of the sprocket 4.

A spool 6 disposed in the body 2 and having a plurality of oil grooves 6*a* around the outer side and a spring 7 elastically supporting the spool 6 form a solenoid valve. The solenoid valve controls the flow of working fluid by selectively communicating with a plurality of oil ports 2*a* formed around the body 2 in response to a control signal from a controller (not shown).

Meanwhile, a cylindrical housing 10, a rotor 20 operating with the camshaft 1 and selectively rotating in the housing 10, and an anti-rotation mechanism 30 making the rotor 20 rotate with the housing 10 by inhibiting or preventing relative rotation of the rotor 20 to the housing 10.

A plurality of projections 12 is formed with predetermined intervals around the inner side 11 of the housing 10. A sealing groove 13 is formed at the free end of each of the projections 12 in the longitudinal direction of the housing 10 and a seal 14 is inserted in the sealing grooves 13, thereby forming spaces 15 between adjacent projections 12.

Meanwhile, a plurality of vanes 22 is formed on a boss 21 coupled to the body 2 and protrudes toward the inner side 11 of the housing 10, as shown in FIG. 2. A sealing groove 23 is formed at the free end of each of the vanes 22 in the longitudinal direction of the rotor 20 and a seal 24 is inserted in the sealing grooves 23, thereby forming spaces 15 between adjacent projections 12 of the housing 10.

The spaces 15 are, as shown in FIG. 2, divided into advance chambers 15*a* and retard chambers 15*b*. The advance chambers 15*a* are in the direction of an arrow B (that is, an advance direction) that is the rotational direction of the camshaft 1, and the retard chambers 15*b* are in the direction of an arrow A (that is, a retard direction) with the vanes 12 therebetween.

Accordingly, working fluid is selectively supplied into the advance chambers 15*a* and the retard chambers 15*b*, and the rotor 20 is rotated in the direction of the arrow B (advance direction) with respect to the housing by torque acting in the vanes 12, thereby adjusting the advance phase. The rotor 20 may be rotated in the direction of the arrow A (retard direction), thereby adjusting the retard phase. With these arrangements, the valve timing of an intake valve or an exhaust valve is adjusted.

The anti-rotation mechanism 30 is provided for emergency operation to selectively inhibit relative rotation between the rotor 20 and the housing 10 and thus to rotate them together. Meanwhile, the anti-rotation mechanism 30 may allow the rotor 20 to freely rotate relative to the housing 10.

In particular, the anti-rotation mechanism 30 may be disposed on one of the vanes 12, as shown in FIG. 2. For the convenience of description, the vane 22 having the anti-rotation mechanism 30 is indicated by reference numeral 22A to be distinguished from other vanes 22.

The anti-rotation mechanism 30, as shown in FIG. 1 or 3, includes a locking pin member 40 inserted in a fitting hole 25 formed through the vane 22A, and a plurality of locking grooves 50 formed in the ratchet plate 5 to be locked to or unlocked from the locking pin member 40.

The locking pin member 40, as shown in FIG. 3, has an upper cap 41 closing a first end (the upper end in FIG. 3) of the fitting hole 25 of the vane 22A, a hollow cylinder-shaped outer pin 43 elastically disposed under the upper cap 41 by an outer spring 42, and an inner pin 45 slidably disposed in the inside 43*a* of the outer pin 43 and elastically seated in a first recession 41*a* of the upper cap 41 by an inner spring 44.

The locking pin member 40 may further have a ring-shaped lower cap 46 positioned at a second end (the lower end in FIG. 3) of the fitting hole 25 and supporting the outer side of the outer pin 43.

The outer pin 43, as shown in FIG. 3, has a step-shaped second recession 43*b* at the upper portion to support the lower end of the outer spring 42 and a first flange 43*c* having an L-shaped cross-section protrudes from the second recession 43*b*.

A hollow lifter ring 47 is fitted around the flange 43*c* of the outer pin 43 in close contact manner with the inner side of the fitting hole 25. A second flange 47*a* protrudes at the lower end of the lifter ring 47 to be fitted around the flange 43*c* of the outer pin 43.

Meanwhile, the upper end of the outer spring 42 is supported on a projection 41*b* extending from the first recession 41*a* of the upper cap 41. Further, the inner spring 44 has a first end supported on the bottom of a third recession 45*a* formed in the upper portion of the inner pin 45 and a second end supported on the bottom of the first recession 41*a* of the upper cap 41.

The locking grooves 50 formed on the ratchet plate 5 in the anti-rotation mechanism 30, as shown in detail in FIG. 3, are connected and have different diameters and depths, facing the fitting hole 25 of the vane 22. Further, a first exhaust hole 5*a* for discharging the working fluid in the locking grooves 50 when the locking pin member 40 is locked may be further formed in the ratchet plate 5.

In particular, the locking grooves 50 include a large groove 51 having a larger diameter and a small groove 52 having a smaller diameter. The large and small grooves are connected each other to form a stepped portion 53 having a stepped cross-section along a rotating direction of the rotor 20. As shown in FIG. 2, the large groove 51 is formed with a predetermined depth and has left and right inner sides 51*a* and 51*b*, and the small groove 52 is formed with a predetermined depth and has left and right inner sides 52*a* and 52*b*. The right inner side 51*b* of the large groove 51 may be connected to the right inner side 52*b* of the small groove 52 in the same plane. One or a plurality of first exhaust holes 5*a* may be formed to communicate with each other in any one of the large groove 51 and the small groove 52.

An oil channel 22*b* for supplying working fluid into the space 26 formed around the outer ring 43 or discharging working fluid from the space 26 through the fitting hole 25 is formed at an angle in the vane 22A and communicates with the solenoid valve 8. Further, one or a plurality of second exhaust holes 22*c* that communicate with the first exhaust hole 5*a* of the ratchet plate 5 may be formed in the vane 22A to discharge the working fluid in the locking grooves 40 when the locking pin member 40 is locked.

The operation of the locking structure of a valve timing adjustment apparatus in one form of the present disclosure is described hereafter.

When an engine is normally operated, as shown in FIG. 2, the vane 22A of the rotor 20 makes a retard chamber 15*b* and an advance chamber 15*a* at the left and right sides in the space 15 between adjacent projections 12 and is freely controlled in the advance direction (direction B) or the retard direction (direction A) with respect to the housing 10 by torque from the camshaft 1, whereby the valve timing of an intake valve or an exhaust valve can be adjusted through the camshaft 1.

When the valve timing adjustment apparatus is operated under specific control and a start ability of an engine is correspondingly improved, or when an uncontrollable emergency occurs while an engine is operated, the locking member 40 needs to be naturally locked under specific control, thereby inhibiting or preventing relative rotation of the rotor 20 to the housing 10.

For the convenience of description, the locking operation of the locking member 40 is described with reference to FIG. 4A to 4C. In one form, the locking operation may use positive torque from the camshaft while the vane 22A is biased to an advance position, i.e., the advance chamber 15*a* of the space 15.

Figure 4A:
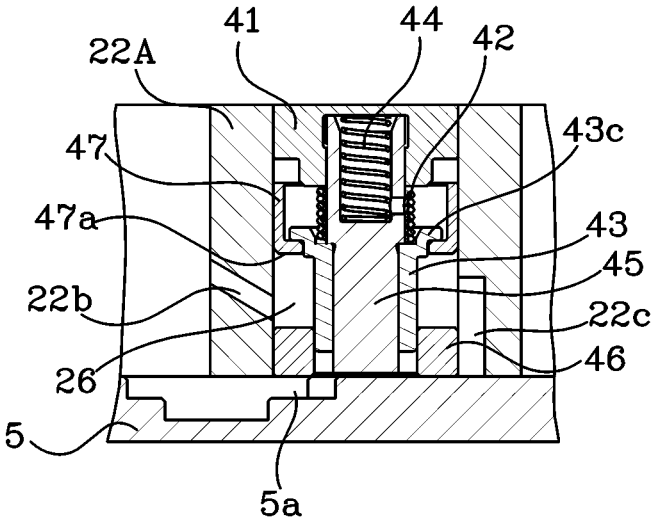
FIGS. 4A to 4C are cross-sectional views sequentially showing that a locking pin member is fitted into a locking groove.

FIG. 4A shows a state when working fluid has been supplied in the space 26 through the oil channel 22*b* formed in the vane 22A. The outer pin 43 and the lifter ring 47 have been maximally lifted to the upper cap 41, both compressing the outer spring 42 due to the pressure of the working fluid. Further, the lower end of the inner pin 45 is lifted from the surface of the ratchet plate 5 by the outer pin 43.

Figure 4B:
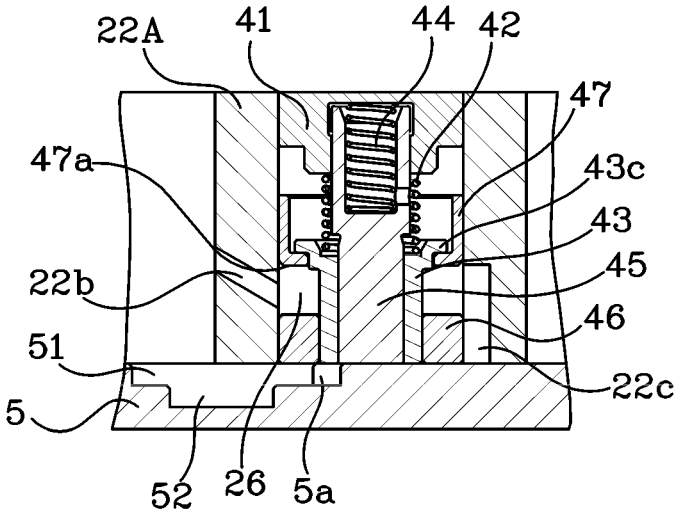

Next, the state shown in FIG. 4B is created by discharging the working fluid through the oil channel 22*b* from the state shown in FIG. 4A. That is, since the pressure of the working fluid applied to the outer pin 43 and the lifter ring 47 is removed, the outer pin 43 and the lifter ring are moved down by the elasticity of the outer spring 42. Accordingly, the lower ends of the outer pin 43 and the inner pin 45 are brought in close contact with the surface of the ratchet plate 5 by the elasticity of the springs 42 and 44.

The outer pin 43 is moved down by the elasticity of the outer spring 42, with the first flange 43*c* locked to the second flange 47*a* of the lifter ring 47, and in this process, the portion being in contact with the inner side of the fitting hole 25 is the outer side of the lifter ring 47 and the outer pin 43 is not in contact with the inner side of the fitting hole 25.

The contact surfaces that are between the inner side of the fitting hole 25 and the outer side of the lifter ring 47 should be controlled in consideration of friction resistance and leakage of the working fluid. In the present disclosure, the cumulative tolerance of the outer pin 43, the inner pin 45, or other components may not affect on a contact surface between the outer side of the lifter ring 47 and the inner side of the fitting hole 25 so that the cumulative tolerance management process become simple and controllable. Accordingly, it is possible to reduce the manufacturing cost of the locking pin member 40 such as the outer pin 43 or the inner pin 45 and improve productivity.

Figure 4C:
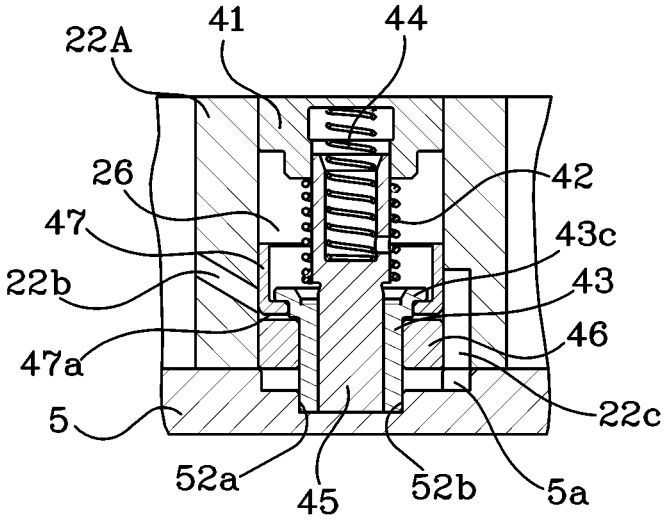

Meanwhile, in the state shown in FIG. 4B, negative torque from the camshaft 1 is transmitted to the vane 22A through the rotor 20, and the vane 22 is rotated at a predetermined angle in the retard direction (the direction A), thereby making the state shown in FIG. 4C.

As shown in FIG. 4B, the outer pin 43 and the inner pin 45 are, together with the lifter ring 47, inserted into the small groove 52 through the large groove 51 of the locking groove 50 by the elasticity of the springs 42 and 44. In this process, the working fluid remaining in the locking groove 50 is discharged to the space 26 around the outer pin 43 through the first exhaust hole 5*a* of the ratchet plate 5 and the second exhaust hole 22*c* formed in the rotor 20 to communicate with the first exhaust hole 5*a*. And then the working fluid is discharged outside through the oil channel 22*b*. With this arrangement, the locking pin member 40 is smoothly locked.

Accordingly, the lower end of the outer pin 43 is locked on the right inner side 52*b* and the left inner side 52*a* of the small groove 52. The vane 22A is in a locking state in which it cannot move in both the retard direction and the advance direction. As a result, the locking pin member 40 is locked in the locking groove 50 of the ratchet plate 5, so the rotor 20 rotates with the housing 10 without rotating relative to the housing 10.

Meanwhile, although the locking pin member 40 is locked by positive torque from the camshaft with the vane 22A biased to the advance chamber 15*a* in the above form, the locking pin member 40 may be locked by negative torque from the camshaft with the vane 22A biased to the retard chamber 15*b*.

Since the negative torque is smaller than the positive torque of the camshaft, the operation of the lifter ring 47 when the outer pin 43 and the inner pin 45 are locked into the locking grooves 50 is substantially the same as the case using positive torque, except that the locking pin member 40 is sequentially locked into the locking grooves 50, so this is not described.

As described above, the lifter ring 47 is in close contact with the outer side of the outer pin 43 and the inner side of the fitting hole 25 of the rotor 20, and the lifter ring 47 is slid up and down on the inner side of the fitting hole 25 by the elasticity of the outer spring 42 and the inner spring 44 and the pressure of the working fluid when the locking pin member 40 is locked. Accordingly, an accumulative tolerance of the outer pin 43 and the inner pin 45 or other components does not have an impact on the contact surface between the outer side of the lifter ring 47 and the inner side of the fitting hole 25, so control of a tolerance of the locking pin member becomes easy, thereby reducing the manufacturing cost and improving productivity.

The above description is just an exemplary form of the present disclosure and the present disclosure is not limited thereto. It should be understood by those skilled in the art that the present disclosure may be changed and modified in various ways within the scope of the present disclosure.

For example, although the rotor 20 has four vanes 22 in the form of the present disclosure, three or other numbers of vanes 22 may be provided, depending on the type or the operational characteristics of an engine.

Further, although one vane 22A has the locking pin member 40, two vanes 22A of the rotor 20 each may have the locking pin member 40.

Although exemplary forms of the present disclosure has been described for illustrative purposes, those skilled in the art will appreciate that various modifications, additions and substitutions are possible, without departing from the scope and spirit of the present disclosure.

What is claimed is:

1. A locking structure of a valve timing adjustment apparatus for an internal combustion engine, and the locking structure comprising:

a housing defining a space with a ratchet plate operatively associated with a crankshaft;

a rotor having a plurality of vanes configured to rotate relative to the housing within a predetermined angle range by a pressure of a working fluid, the rotor disposed in the housing to operate with a camshaft; and an anti-rotation mechanism configured to inhibit or prevent a positional change between the rotor and the housing by inhibiting or preventing relative rotation of the rotor to the housing, wherein the anti-rotation mechanism includes:

a plurality of locking grooves formed on the ratchet plate with different depths and connected to each other; and a locking pin member comprising:

an outer pin elastically disposed in a fitting hole formed in at least one vane of the plurality of vanes, an inner pin elastically disposed inside the outer pin and configured to slide relative to the outer pin, and a lifter ring provided separately from the outer pin and disposed between an inner side of the fitting hole and the outer pin so as to inhibit a direct contact between the inner side of the fitting hole and the outer pin, wherein the lifter is coupled to an upper portion of the outer pin and configured to slide on the inner side of the fitting hole, wherein the rotor is locked to the housing when the outer pin and the inner pin are sequentially fitted in the plurality of locking grooves.

2. The locking structure of claim 1, wherein the plurality of locking grooves includes a large groove having a large diameter and a small groove having a small diameter, wherein the large groove and the small groove form a stepped portion having predetermined depths.

3. The locking structure of claim 1, wherein the locking pin member further has an upper cap having a first recession therein and is configured to close a first end of the fitting hole.

4. The locking structure of claim 3, wherein a second recession is formed at a first end of the outer pin, and an outer spring applying elasticity to the plurality of locking grooves is disposed between the second recession and a first end of the upper cap.

5. The locking structure of claim 4, wherein a first flange protrudes from the second recession of the outer pin, and a second flange coupled to the first flange of the outer pin protrudes from a lower end of the lifter ring.

6. The locking structure of claim 5, wherein a third recession is formed at a first end of the inner pin, and an inner spring applying elasticity to the plurality of locking grooves is disposed between the third recession and the first recession of the upper cap.

7. The locking structure of claim 6, wherein the locking pin member further has a lower cap configured to close a second end of the fitting hole and configured to support an outer side of the outer pin.

8. The locking structure of claim 1, wherein a first exhaust hole is configured to discharge the working fluid when the locking pin member is locked is additionally formed in the ratchet plate.

9. The locking structure of claim 8, wherein a second exhaust hole in communication with the first exhaust hole is additionally formed in the rotor and is configured to discharge the working fluid from the plurality of locking grooves when the locking pin member is locked.

* * * * *